US005194093A

United States Patent [19]

Boussely et al.

[11] Patent Number: 5,194,093

[45] Date of Patent: Mar. 16, 1993

[54] PROCESS FOR THE DECOLORATION OF SUGAR LIQUOR

[75] Inventors: Jean-Francois Boussely, Saint-Denis; Michel Pouillot, Ville d'Avray, both of France

[73] Assignee: Atochem, Puteaux, France

[21] Appl. No.: 745,981

[22] Filed: Aug. 5, 1991

Related U.S. Application Data

[63] Continuation of Ser. No. 586,199, Sep. 21, 1990, abandoned.

[30] Foreign Application Priority Data

Sep. 21, 1989 [FR] France ..... 89 12615

[51] Int. Cl.[5] ..... C13D 1/14

[52] U.S. Cl. ..... 127/34; 127/43; 127/44

[58] Field of Search ..... 127/43, 44

[56] References Cited

U.S. PATENT DOCUMENTS 4,076,552 2/1978 Farag et al. ..... 127/50

4,196,017 4/1980 Melville et al. ..... 127/41

FOREIGN PATENT DOCUMENTS 324248 8/1975 Austria .

775471 12/1934 France .

OTHER PUBLICATIONS

E. Delden "Standard Fabrication Practices for Cane Sugar Mills", 1981, sugar series, vol. 1, p. 51, Elsevier Scientific Publishing Co., Amsterdam, NL.

*Primary Examiner*—Theodore Morris

*Assistant Examiner*—P. L. Hailey

*Attorney, Agent, or Firm*—Burns, Doane, Swecker & Mathis

[57] ABSTRACT

Process for the extraction of the sugar contained in plants such as sugar beets or sugar cane, wherein the concentration of a dilute liquor by the evaporation of water to obtain a liquor from which the sugar may be separated by crystallization, is applied to a liquor to which hydrogen peroxide has been added and the pH of which is between 8 and 9.5 after the addition of hydrogen peroxide.

25 Claims, No Drawings

PROCESS FOR THE DECOLORATION OF SUGAR LIQUOR

This application is a continuation of application Ser. No. 07/586,199, filed Sep. 21, 1990, now abandoned.

The present invention concerns a process for the decoloration of sugar liquor in the extraction of the sugar contained in plants, such as sugar beets or sugar cane, more particularly a process for the decoloration of such a juice using hydrogen peroxide.

The extraction of sugar commonly comprises four principal operations:

the formation of a raw liquor, for example by the crushing of the plants, as in the case of sugar cane, or by the diffusion of the sugar of the plant in water, as in the case of sugar beets, the cleansing or purification of the raw liquor by the action of lime, called lime defecation, followed by defeco-carbonation then sulfitation and optionally by decalcification, to obtain a purified liquor, which relative to the raw liquor contains a quantity of impurities, the "non-sugars", reduced most often to less than half, the concentration of the purified liquor by the evaporation of water, to yield a concentrated liquor or dense liquor, a syrupy liquid generally containing of the order of 70% sugar, from which the sugar may be separated by crystallization, the crystallization of the dense liquor, followed by drying, to obtain commercial white sugar and molasses as the residue.

A description of the extraction of sugar may be found for example in "Sucrerie Fran aise", October 1985, 439–454 or in U.S. Pat. No. 4,076,552.

The presence of colored impurities or coloration generators in the dense liquor hinder or even make it impossible to obtain crystallized sugar of satisfactory quality.

As shown by the aforecited references, at the present time the effect of such impurities is limited by sulfitation. The commonly used sulfitation agent is $SO_2$.

It has not only the disadvantages relative to its odor and toxicity, but also that of leaving residual sulfur both in the effluents of crystallization and in the sugar produced, while standards and recommendations in this field are becoming more and more strict.

The replacement of sulfitation by an operation at least as effective, but without sugar quality problems, is thus desired by the industry.

R. F. MADSEN, W. KOFOD NIELSEN, B. WINSTROM-OLSEN, T. E. NIELSEN, "Sugar Technology Review", 6(1878/79), 49–115, in particular pages 108–110, found that the addition of hydrogen peroxide in the diffusion or to the raw liquor has a favorable effect on the coloration of the liquor prior to concentration, while it is not possible to eliminate sulfitation, which remains one of the conditions necessary to prevent exaggerated browning during evaporation. The addition of hydrogen peroxide in the diffusion has the additional disadvantage of deepening the color of the vegetable matter depleted of its sugar, the pulp, the bleaching of which in view of its utilization in feeds becomes more difficult and expensive.

The addition of hydrogen peroxide to the raw liquor is also disclosed in the aforecited U.S. Pat. No. 4,076,552. According to this patent, the hydrogen peroxide must be added to the raw liquor prior to and/or during carbonation. For better performance, this method requires that during a first carbonation in the absence of hydrogen peroxide the pH be maintained within narrow limits. In addition, the hydrogen peroxide must be added in the presence of a sufficiently large quantity of calcium carbonate, without which its effect is minor and may even result in a stronger coloration of the liquor. The patent confirms the observation of R. F. MADSEN & al. cited above, relative to the need of following the action of hydrogen peroxide by sulfitation prior to concentration. The patent further teaches that one of the functions of sulfitation is to assure the destruction of all of the residual hydrogen peroxide, which otherwise would have a detrimental effect on the quality of the sugar produced.

Thus, according to the state of the art, hydrogen peroxide cannot be substituted for a sulfitation agent, such as $SO_2$ in the treatment of a liquor which is to undergo concentration by water evaporation and which is designated hereafter as the dilute liquor.

However, it is this substitution that makes possible the process of the invention, which does not have the disadvantages described above and is carried out independently of the operations of obtaining the raw liquor and the lime-carbonation treatment while effectively limiting the coloration of the concentrated liquor.

The present invention consists of a process for the extraction of the sugar contained in plants, such as sugar beets or sugar cane, a process in which a dilute liquor is concentrated by the evaporation of water to yield a liquor in which the sugar may be separated by crystallization, characterized in that concentration by water evaporation is carried out on a dilute liquor to which hydrogen peroxide has been added, with the pH of said liquor after the addition of hydrogen peroxide being between 8 and 9.5.

The process described above relative to the four principal operations of the extraction is valid also for the process of the invention, obviously with the exception of sulfitation, which is eliminated.

The quality of the hydrogen peroxide added to the dilute liquor may vary within rather wide limits, but appreciable results are generally not obtained if less than about 30 g hydrogen peroxide are added, calculated as 100% per ton of the raw material, such as beets or cane, extracted to form the raw liquor, as described above.

In all of the following, the quantity of hydrogen peroxide added to the dilute liquor is calculated as set forth above. Preferably, it is between 50 g/ton and 100 g/ton.

The hydrogen peroxide is added to the raw liquor to be concentrated normally in the form of a commercial aqueous solution containing 35% to 50% by weight of hydrogen peroxide.

The dilute liquor, with the hydrogen peroxide added, is at a temperature between approximately 20° and 150° C., but preferably within the range of temperature at which the concentration of the dilute liquor is carried out by water evaporation, for example between approximately 40° and 120° C., preferably between about 60° and 100° C.

The dilute liquor, with the hydrogen peroxide added, is at a pressure which may depend on the temperature chosen and which normally is between the atmospheric pressure and a lower pressure equal to approximately 0.08 bar, most frequently between the atmospheric pressure and about 0.1 bar.

The pH of the dilute liquor, after the addition of the hydrogen peroxide, is preferably between 8.5 and 9.

It may be obtained naturally merely by the addition of the hydrogen peroxide to the dilute liquor, or it may be adjusted by means of a non-sulfur agent compatible with food, such as for example acetic acid.

If the dilute liquor after the addition of hydrogen peroxide has a pH higher than 9.5 when exposed to concentration by the evaporation of water, the dense liquor obtained is significantly more colored than that resulting from the concentration by evaporation of the same dilute liquor without the addition of hydrogen peroxide, but subjected to sulfitation prior to concentration.

If the dilute liquor after the addition of hydrogen peroxide has a pH lower than 8 when subjected to concentration by water evaporation, the crystallization of the sugar from the dense liquor becomes difficult.

The dilute liquor to which hydrogen peroxide is added, most often contains 10 to 50% by weight sugar.

The dilute sugar to which the invention is applied may in effect be a dilute liquor not as yet concentrated by water evaporation, and/or a liquor already partially concentrated in this manner during its conversion to a dense liquor, from which the sugar is separated by crystallization.

The intended result of the present invention is normally attained during a duration from the instant the hydrogen peroxide is applied and when the dilute liquor is recovered in the form of a dense liquor, said duration not exceeding about 20 min. Most frequently, this duration is of the order of 5 to 15 min.

The equipment to carry out the present invention, from the application of the hydrogen peroxide to the obtention of the dense liquor, is that designed at the present time to be suitable for the concentration by water evaporation of a dilute liquor into a dense liquor. The material selected must be suitable for use under the conditions of the process and satisfy the requirements of the nutritional field. Stainless steel fulfills both of these requirements.

The invention will become more apparent from the following examples, given as nonlimiting illustrations and comparing the invention with the known processes.

In the examples the coloration of the liquors is determined by measuring the absorbance at 420 nm with the aid of a refractometer, of the different liquors concerned, filtered on a porous membrane. This method is known to those skilled in the art. It is based on the formula established for the European Community and has been described for example in 1984 by IRIS-Institut de Recherche de l'Industrie Sucrière (Research Institute of the Sugar Industry).

In each of the examples, the value of 100 is assigned to the coloration of dense liquor obtained from dilute liquor to which the present invention has been applied.

In each of the examples a coloration value higher than 100 signifies for the dilute liquor or for a liquor obtained from it, other than the dense liquor obtained according to the invention, a deeper coloration than that of said dense liquor.

In contrast, a coloration value lower than 100 indicates for the dilute liquor or for a liquor derived from it other than the liquor obtained according to the invention, a whiter coloration than that of said dense liquor.

The initial liquors used in all of the examples are industrial dilute liquors. They contain, in addition to water and impurities, 14 to 15% by weight sugar.

The hydrogen peroxide is used in the form of a commercial aqueous solution containing 35% hydrogen peroxide by weight. The values of the quantities of hydrogen peroxide used are expressed in grams of hydrogen peroxide 100% per ton of the raw material extracted to form the raw liquor, g/t, as mentioned above.

If sulfitation of the dilute liquor takes place prior to the evaporation of water instead of the application of hydrogen peroxide according to the invention, it is carried out in the conventional manner, with $SO_2$, used in a proportion of 205 g/ton of material as defined relative to the quantities of hydrogen peroxide.

The raw material here is sugar beets.

EXAMPLE 1

To the initial dilute liquor, the pH of which is equal to 9.3 and the coloration value of which is 90, hydrogen peroxide is added in a proportion of 73.5 g/t.

After the addition of the hydrogen peroxide, the pH of the liquor is adjusted to 8.5 by means of acetic acid and the liquor remains in this state for 10 min.

During this period, the temperature of the liquor is equal to a value maintained between 90° and 100° C. The pressure is atmospheric.

The liquor is then concentrated by the evaporation of water at atmospheric pressure, so that the dense liquor recovered contains 68% by weight sugar.

Its coloration is equal to 100 as specified.

If the same initial dilute liquor is concentrated at atmospheric pressure after it has been sulfited, the dense liquor again contains 68% by weight sugar and has a coloration of 102.5.

After carrying out the concentration by water evaporation at atmospheric pressure directly on the initial dilute liquor used in this example, the coloration of the dense liquor obtained, which again contains 68% by weight sugar, is equal to 205.

EXAMPLE 2

The initial process of Example 1, which incorporates the invention, is followed by leaving the dilute liquor, after the addition of hydrogen peroxide, at the pH of 9.2 naturally obtained by said addition.

The dense liquor obtained has a coloration the value of which is practically equal to that of the dense liquor obtained in Example 1 from the sulfited liquor.

EXAMPLE 3

An industrial dilute liquor other than the one used in Examples 1 and 2 has a coloration equal to 108.5. It is charged into an evaporator operating at a pressure lower than atmospheric, equal to about 0.1 bar, so that the temperature of the liquor during its concentration by water evaporation remains between 65° and 75° C.

70 g/t hydrogen peroxide are added to the dilute liquor during its rise in temperature from the ambient to the working temperature. Following the addition of the hydrogen peroxide, the pH of the dilute liquor is adjusted as in Example 1 to a value of 8.5.

The dense liquor obtained contains 70.5% by weight sugar and its coloration is equal to 100, as specified.

The dense liquor, with a concentration in sugar also equal to 70.5% by weight, obtained by replacing in the process the addition of hydrogen peroxide and the pH correction, by sulfitation, has a coloration of 108.

The above examples show that the use of hydrogen peroxide according to the invention at the time of the concentration of a dilute liquor by the evaporation of water to form a dense liquor, leads to dense liquors with a coloration at least as satisfactory as those obtained by carrying out said concentration on a sulfited dilute liquor.

The white sugar obtained by crystallization by means of the process used in industry from different dense liquors resulting from the examples of the application of the invention, satisfies in every case the criteria of coloration, those of saccharose content, ash content and possible the sulfur content, imposed by the market.

We claim:

1. A process for the decolorization and extraction of sugar from a plant material selected from the group consisting of sugar cane and sugar beet, in the absence of a sulfiting agent, comprising:

(a) adding to a dilute plant liquor comprising sugar an amount of hydrogen peroxide which is sufficient for decolorization and extraction of said sugar;

(b) adjusting the pH of said plant liquor to which hydrogen peroxide has been added, using a non-toxic non-sulfur containing acid, such that it is between 8 and 9.5; and (c) concentrating the resulting plant liquor by evaporation.

2. The process according to claim 1, wherein the quantity of hydrogen peroxide added is greater than 30 g/t.

3. The process according to claim 2, wherein the temperature of the dilute liquor to which hydrogen peroxide has been added, is between 20° and 150° C.

4. The process according to claim 2, wherein the temperature of the dilute liquor to which hydrogen peroxide has been added is between 40° and 100° C.

5. The process according to claim 2, wherein the temperature of the dilute liquor to which hydrogen peroxide has been added is between 60° and 100° C.

6. The process according to claim 2, wherein the dilute liquor to which the hydrogen peroxide has been added, is at a pressure between atmospheric and 0.08 bar.

7. The process according to claim 2, wherein the dilute liquor, to which hydrogen peroxide has been added, is at a pressure between atmospheric and 0.1 bar.

8. The process according to claim 2, wherein the pH of the dilute liquor after the addition of hydrogen peroxide is between 8.5 and 9.

9. The process according to claim 2, wherein the dilute liquor contains between 10 and 50% by weight sugar.

10. The process according to claim 2, wherein the quantity of hydrogen peroxide is between 50 g/t and 100 g/t.

11. The process according to claim 10, wherein the temperature of the dilute liquor to which hydrogen peroxide has been added, is between 20° and 150° C.

12. The process according to claim 10, wherein the temperature of the dilute liquor to which hydrogen peroxide has been added is between 40° and 100° C.

13. The process according to claim 10, wherein the temperature of the dilute liquor to which hydrogen peroxide has been added is between 60° and 100° C.

14. The process according to claim 10, wherein the dilute liquor to which the hydrogen peroxide has been added, is at a pressure between atmospheric and 0.08 bar.

15. The process according to claim 10, wherein the dilute liquor, to which hydrogen peroxide has been added, is at a pressure between atmospheric and 0.1 bar.

16. The process according to claim 10, wherein the pH of the dilute liquor after the addition of hydrogen peroxide is between 8.5 and 9.

17. The process according to claim 10, wherein the dilute liquor contains between 10 and 50% by weight sugar.

18. The process according to claim 1, wherein the temperature of the dilute liquor to which hydrogen peroxide has been added, is between 20° and 150° C.

19. The process according to claim 1, wherein the temperature of the dilute liquor to which hydrogen peroxide has been added is between 40° and 100° C.

20. The process according to claim 1, wherein the temperature of the dilute liquor to which hydrogen peroxide has been added is between 60° and 100° C.

21. The process according to claim 1, wherein the dilute liquor to which the hydrogen peroxide has been added, is at a pressure between atmospheric and 0.08 bar.

22. The process according to claim 1, wherein the dilute liquor, to which hydrogen peroxide has been added, is at a pressure between atmospheric and 0.1 bar.

23. The process according to claim 1, wherein the pH of the dilute liquor after the addition of hydrogen peroxide is between 8.5 and 9.

24. The process according to claim 1, wherein the dilute liquor contains between 10 and 50% by weight sugar.

25. The process according to claim 1, wherein the non-toxic non-sulfur containing acid is acetic acid.

* * * * *